US008061130B2

(12) United States Patent
Shibasaki

(10) Patent No.: US 8,061,130 B2
(45) Date of Patent: Nov. 22, 2011

(54) COLLECTING PART STRUCTURE OF EXHAUST MANIFOLD

(75) Inventor: Takashi Shibasaki, Saitama (JP)

(73) Assignee: Calsonic Kansei Corporation, Saitama-shi (JP)

( * ) Notice: Subject to any disclaimer, the term of this patent is extended or adjusted under 35 U.S.C. 154(b) by 494 days.

(21) Appl. No.: 12/374,011

(22) PCT Filed: Jun. 25, 2007

(86) PCT No.: PCT/JP2007/062678

§ 371 (c)(1),
(2), (4) Date: Jan. 15, 2009

(87) PCT Pub. No.: WO2008/010390

PCT Pub. Date: Jan. 24, 2008

(65) Prior Publication Data

US 2009/0288405 A1 Nov. 26, 2009

(30) Foreign Application Priority Data

Jul. 19, 2006 (JP) ..... 2006-196307

(51) Int. Cl.
*F01N 7/10* (2006.01)

(52) U.S. Cl. ..... 60/323; 60/272; 60/313; 60/322; 60/324

(58) Field of Classification Search ..... 60/272, 60/312, 313, 322, 323, 324
See application file for complete search history.

(56) References Cited

U.S. PATENT DOCUMENTS

| | | | | |
|---|---|---|---|---|
| 4,745,742 | A * | 5/1988 | Nada et al. | 60/276 |
| 6,082,103 | A * | 7/2000 | Sugiura et al. | 60/323 |
| 6,722,126 | B2 * | 4/2004 | Kawamizu | 60/324 |
| 6,918,246 | B2 * | 7/2005 | Fukumoto et al. | 60/323 |
| 7,454,901 | B2 * | 11/2008 | Kato et al. | 60/324 |
| 7,503,171 | B2 * | 3/2009 | Saito | 60/323 |
| 7,610,748 | B2 * | 11/2009 | Kono et al. | 60/276 |

FOREIGN PATENT DOCUMENTS

| | | | |
|---|---|---|---|
| JP | 58-094738 | A | 6/1983 |
| JP | 60-003226 | A | 1/1985 |
| JP | 2003-083062 | A | 3/2003 |
| JP | 2004-116382 | A | 4/2004 |
| JP | 2004-245156 | A | 9/2004 |

* cited by examiner

*Primary Examiner* — Binh Q. Tran
(74) *Attorney, Agent, or Firm* — Foley & Lardner LLP

(57) ABSTRACT

An exhaust manifold A includes, in its collecting part structure, a plurality of branch pipes 2 to 5 that are connected with a flange head 1, a collecting part 6 that collects and contains exhaust-gas downstream side end portions 2*a* to 5*a* of the branch pipes 2 to 5, a partition plate 10 that is arranged in a state where its exhaust-gas downstream side end portion 10*a* projects in the interior of the collecting part 6, and a sensor attachment boss part 9 that is fixed by weld line X on a part of an outer circumferential portion of the collecting part 6 in a state where it faxes an insertion hole 6*f* formed in the collecting part 6. Insertion holes 6*g* and 6*h* are formed in a reduced diameter portion 6*e* of the collecting part 6 of the exhaust manifold A, and the partition plate 10 is fixed by a weld line X5 with a portion of the outer circumferential portion of the collecting part 6 in a state where portions 10*c* and 10*d* of both end portion of the partition plate 10 are inserted in and positioned to the insertion holes 6*g* and 6*h*.

1 Claim, 7 Drawing Sheets

COLLECTING PART STRUCTURE OF EXHAUST MANIFOLD

TECHNICAL FIELD

The present invention relates to a collecting part structure of an exhaust manifold that constitutes a part of an exhaust system for discharging exhaust gas outputted from an engine mounted on a motor vehicle.

BACKGROUND OF THE INVENTION

A technology of a collecting part structure of an exhaust manifold is disclosed in Japanese Patent applications Publication No. 2004-245156 and No. 2004-116382, and they include a plurality of branch pipes, a collecting part, a partition plate and a sensor attachment boss part, where the branch pipes have exhaust-gas upstream side end portions that are connected with a head flange of an engine, the collecting part collects and contains exhaust-gas downstream side end portions of the branch pipes, the partition plate has an exhaust-gas upstream side end portion that is fixed among the exhaust-gas downstream side end portions of the branch pipes and an exhaust-gas downstream side end portion that is arranged to project in an interior of the collecting part, and the sensor attachment boss part is welded on an outer circumferential portion of the collecting part to face an attachment hole formed in the collecting part.

In addition, the partition plate is provided to obtain objects for a function for portioning the branch pipes when the branch pipes are welded with each other, an improvement in sensitivity of an oxygen sensor and a prevention of interference of exhaust gasses discharged through the branch pipes. A portion of the partition plate is fixed by welding on a portion of the outer circumferential portion of the collecting part in a state where the partition plate is positioned by the part thereof being inserted into a slit formed in a portion of the collecting part along from an exhaust-gas upstream side end portion to an intermediate portion of the collecting part.

DISCLOSURE OF THE INVENTION

Problem(s) to be Solved by the Invention

The conventional exhaust manifolds, however, have the following problems. The slit is formed in the collecting part along from the exhaust-gas upstream side end portion to the intermediate portion thereof, so that the exhaust-gas upstream side end portion of the collecting part decreases its diameter at times due to a heat input generated in a welding process and an aperture width of the slit is narrowed. As a result, the partition plate could not be inserted through the slit from above, and an assembly performance of the partition plate and the collecting part sometimes deteriorates.

Further, there is another problem in that a heat stress concentrates on a cross portion of a first welding line that is formed when the partition plate is welded along the slit, and a second welding line that is formed when the branch pipes are welded along an entire circumference of the exhaust-gas upstream side end portion of the collecting part.

Incidentally, it is difficult for practical purposes to fix the sensor attachment boss part on the collecting part by welding in latter process because of a small space for welding work.

In addition, in order to prevent the slit from being narrowed in the aperture width thereof, the slit may be formed after the sensor attachment boss part is fixed on the collecting part by welding. These processes, however, take a lot of trouble and hours because a cutting process is needed after the welding process, and they cannot avoid the concentration of the heat stress that is easily occurs at a periphery of the cross portion of the first and second welding lines.

The present invention is made to solve the above-described problem, and its object is to provide a collecting part structure of an exhaust manifold in which an assembly performance of a partition plate and a collecting part can be improved and additionally a concentration of a heat stress can be eased in a welding process.

Means for Solving the Problems

According to a first aspect of the present invention there is provided a collecting part structure of an exhaust manifold including a plurality of branch pipes, a collecting part, a partition plate and a sensor attachment boss part. The branch pipes have exhaust-gas upstream side end portions that are connected with a head flange. The collecting part collects and contains exhaust-gas downstream side end portions of the branch pipes. The partition plate has an exhaust-gas upstream side end portion is fixed among the exhaust-gas downstream side end portions of the branch portions, and the partition plate is arranged in a state where an exhaust-gas downstream side end portion of the partition plate projects in an interior of the collecting part. The sensor attachment boss part is fixed by welding on a portion of an outer circumferential portion of the collecting part in a state where the sensor attachment boss part faces an attachment hole formed in the collecting part. A plurality of insertion holes are formed in a reduced diameter portion of the collecting part. The partition plate is fixed by welding on a portion of the outer circumferential portion of the collecting part in a state where portions of the partition plate are inserted in and positioned to the insertion holes.

Effect of the Invention

The collecting part structure of the exhaust manifold includes the plurality of branch pipes, the collecting part, the partition plate and the sensor attachment boss part. The branch pipes have the exhaust-gas upstream side end portions that are connected with the head flange. The collecting part collects and contains the exhaust-gas downstream side end portions of the branch pipes. The partition plate has the exhaust-gas upstream side end portion is fixed among the exhaust-gas downstream side end portions of the branch portions, and the partition plate is arranged in the state where the exhaust-gas downstream side end portion of the partition plate projects in the interior of the collecting part. The sensor attachment boss part is fixed by welding on the portion of an outer circumferential portion of the collecting part in the state where the sensor attachment boss part faces the attachment hole formed in the collecting part. The plurality of insertion holes are formed in the reduced diameter portion of the collecting part. The partition plate is fixed by welding on the portion of the outer circumferential portion of the collecting part in the state where portions of the partition plate are inserted in and positioned to the insertion holes.

Therefore, the assembly performance of the partition plate 10 and the collecting part 6 can be improved. In addition, the concentration of the heat stress can be eased in the welding process.

BRIEF DESCRIPTION OF THE DRAWINGS

The objects, features and advantages of the present invention will become apparent as the description proceeds when taken in conjunction with the accompanying drawings, in which.

DESCRIPTION OF REFERENCE NUMBERS

Figure 1:
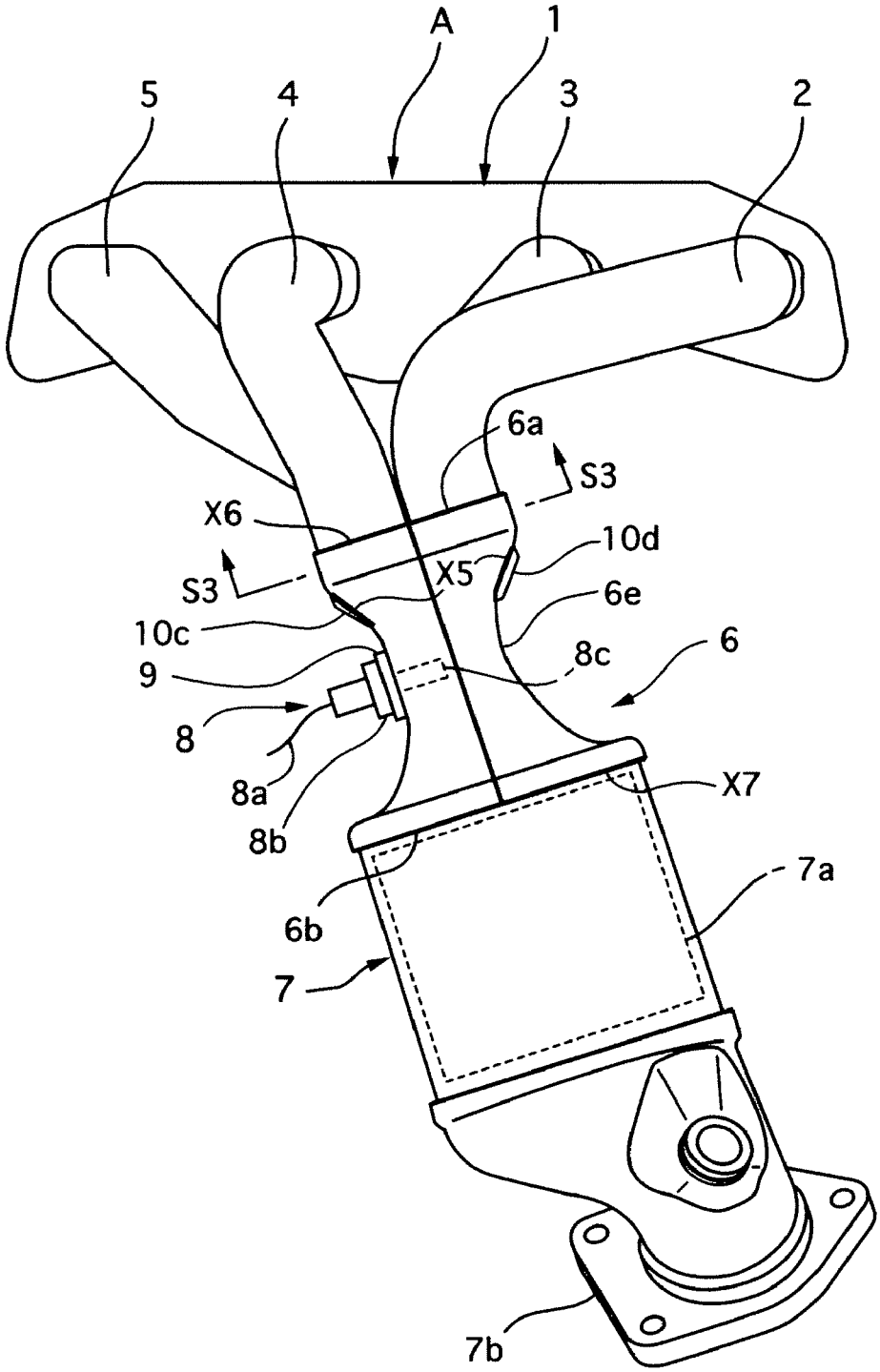
FIG. 1 is a front view showing an exhaust manifold of a first embodiment according to the present invention.

A exhaust manifold
1 head flange
1*a* attachment hole
2, 3, 4, 5 branch pipe
2*a*, 3*a*, 4*a*, 5*a* exhaust-gas downstream side end portion
2*b*, 3*b*, 4*b*, 5*b* side portion (which contacts with a partition plate)
2*c*, 3*c*, 4*c*, 5*c* adjacent side portions
6 collecting part
6*a* exhaust-gas upstream side end portion
6*b* exhaust-gas upstream side end portion
6*c*, 6*d* divided body
6*e* reduced diameter portion
6*f* attachment hole
6*g*, 6*h* insertion hole
6*i*, 6*j* deepest portion
7 catalytic converter
7*a* catalyst
7*b* flange portion
8 oxygen sensor
8*a* wiring
8*b* holder portion
8*c* sensing portion
9 sensor attachment boss part
10 partition plate
10*a* exhaust-gas downstream side end portion
10*b* engagement stepped portion
10*c*, 10*d* a portion of an end portion of the partition plate

BEST MODE FOR CARRYING OUT THE INVENTION

Throughout the following detailed description, similar reference characters and numbers refer to similar elements in all figures of the drawings, and their descriptions are omitted for eliminating duplication.

Hereinafter, an embodiment of the present invention will be described with reference to the accompanying drawings.

First Embodiment

Figure 3:
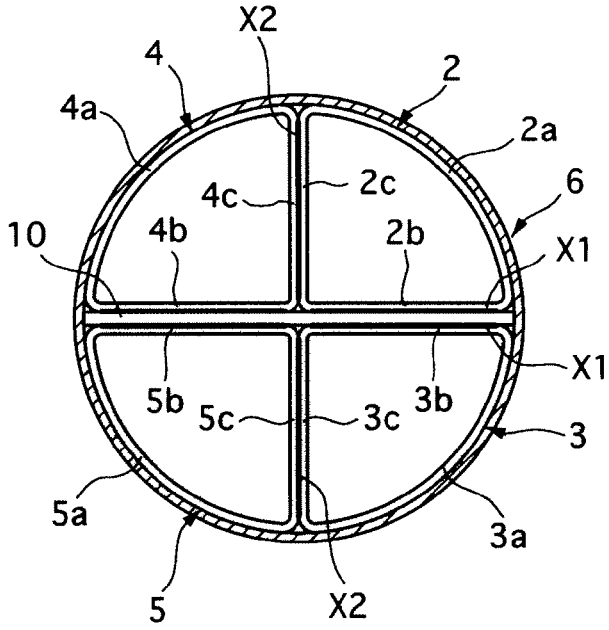
FIG. 3 is a cross sectional view of the exhaust manifold taken along a line S3-S3 in FIG. 1.
Figure 4:
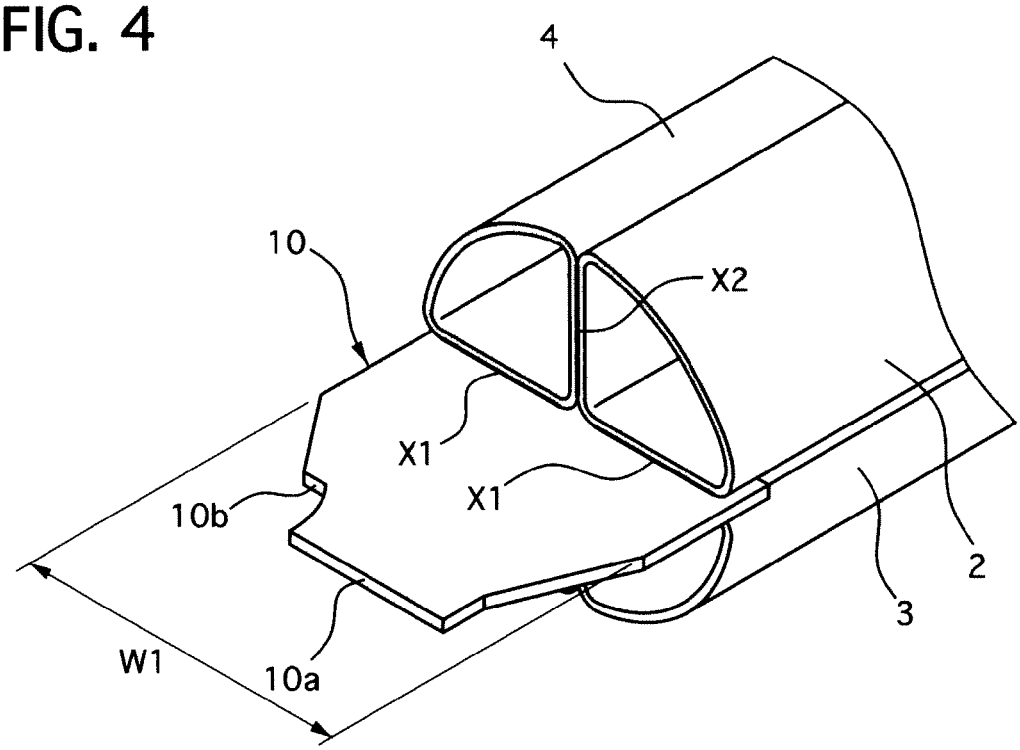
FIG. 4 is a perspective view illustrating a partition plate of the exhaust manifold of the first embodiment.

A first embodiment of the present invention will be described. FIG. 1 is a front view showing an exhaust manifold of the first embodiment according to the present invention, FIG. 2 is a right side view showing the same, FIG. 3 is a cross sectional view of the same taken along a line S3-S3 in FIG. 1, and FIG. 4 is a perspective view illustrating a partition plate of the first embodiment.

Figure 5:
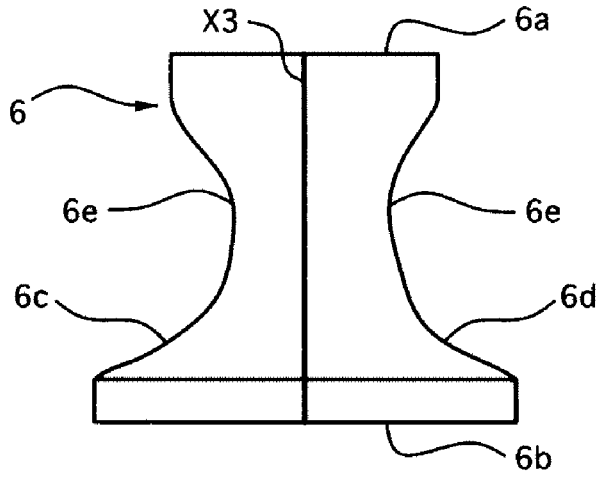
FIG. 5 is a front view showing a collecting part of the exhaust manifold of the first embodiment.
Figure 6:
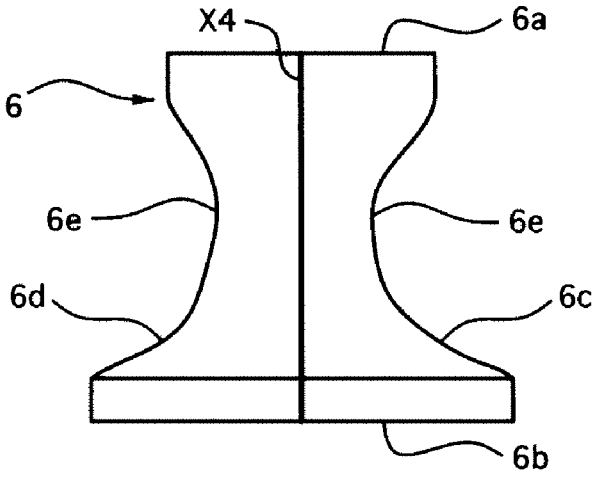
FIG. 6 is a rear view showing the collecting part shown in FIG. 5.
Figure 7:
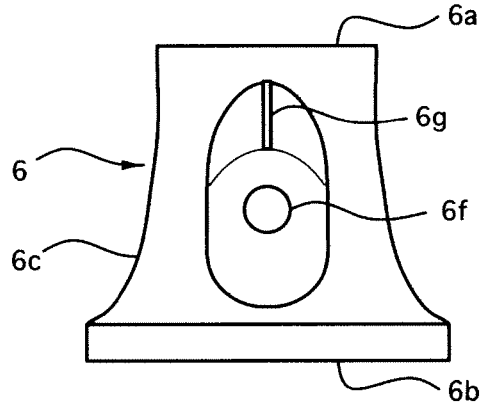
FIG. 7 is a right side view showing the collecting part shown in FIG. 5 and FIG. 6.
Figure 8:
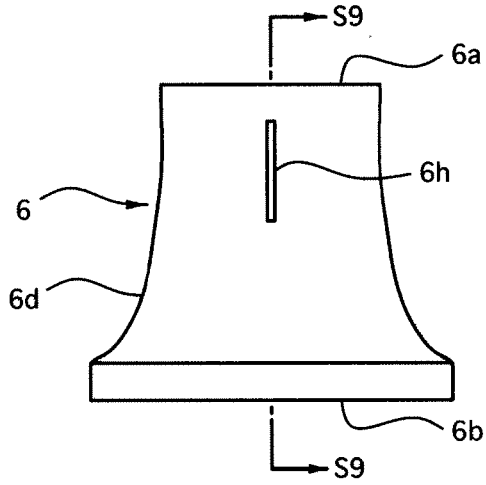
FIG. 8 is a left side view showing the collecting part shown in FIGS. 5 to 7.
Figure 9:
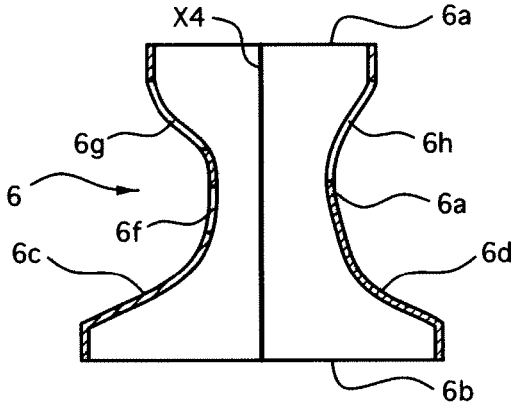
FIG. 9 is a cross sectional view of the collecting part taken along a line S9-S9 in FIG. 8.
Figure 10:
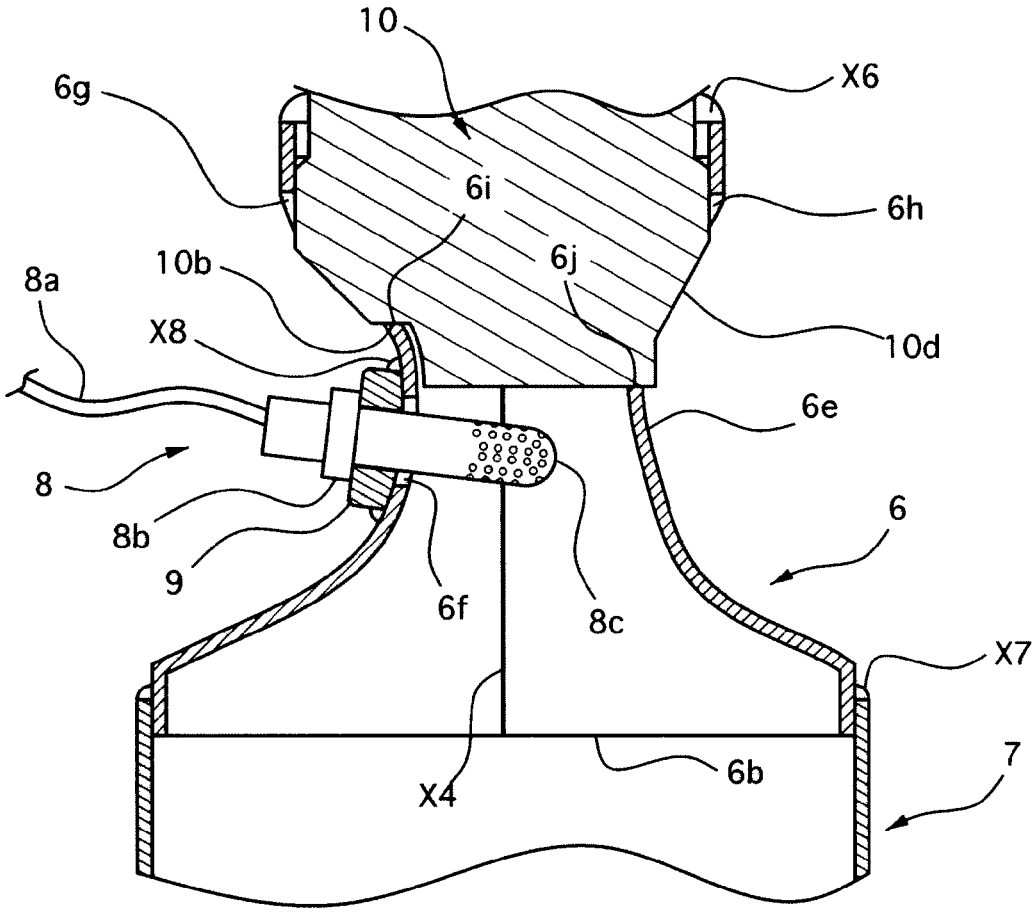
FIG. 10 is a cross sectional side view illustrating an interior of the collecting part of the exhaust manifold of the first embodiment.
Figure 11:
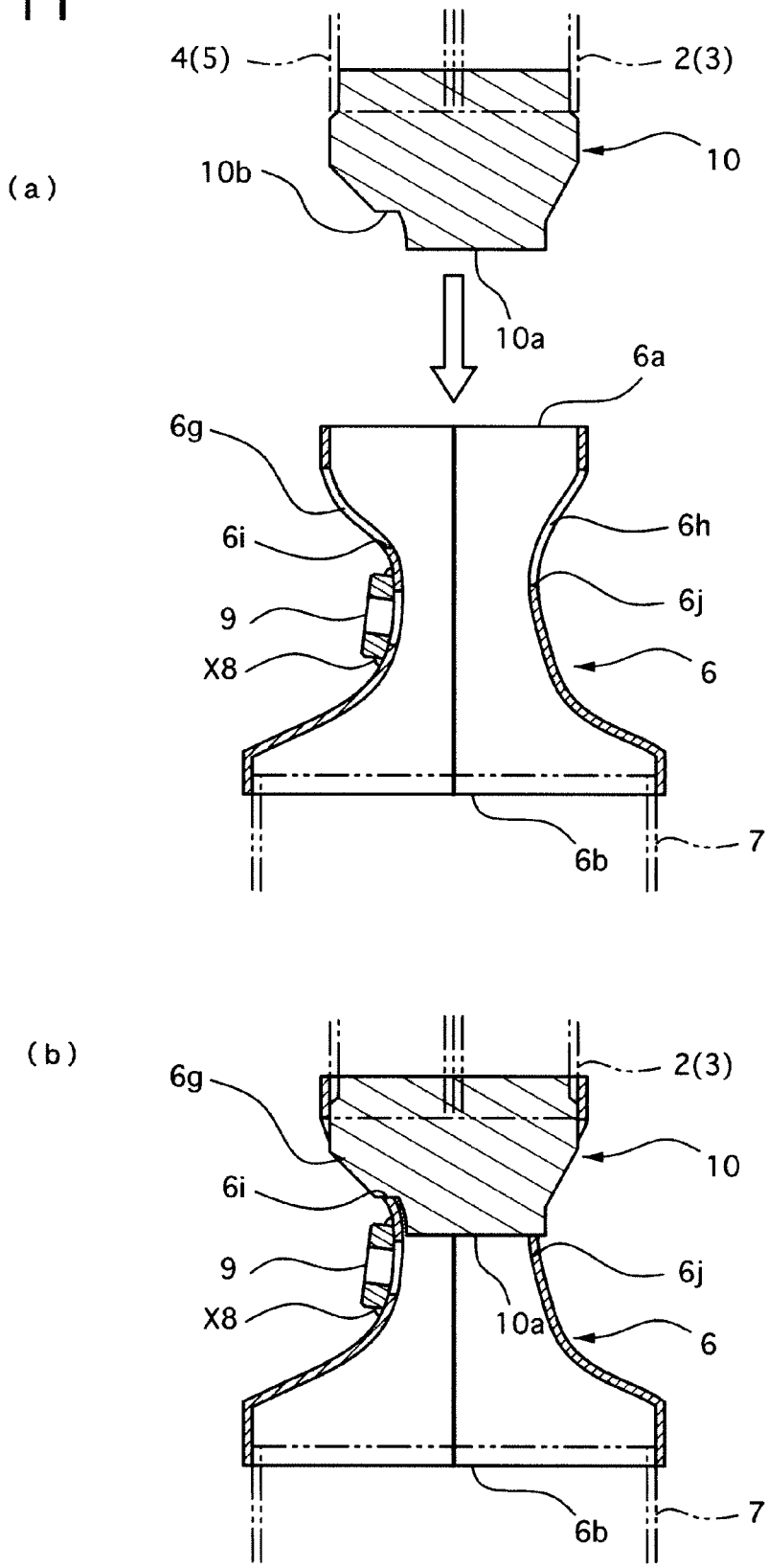
FIG. 11 is a view illustrating a fixation of the partition plate and the collecting part of the exhaust manifold of the first embodiment.

FIG. 5 is a front view showing a collecting part of the exhaust manifold of the first embodiment, FIG. 6 is a rear view showing the same, FIG. 7 is a right side view showing the same, FIG. 8 is a left side view showing the same, FIG. 9 is a cross sectional view of the same taken along a line S9-S9 in FIG. 8, FIG. 10 is a cross sectional view illustrating the collecting part of the first embodiment, and FIG. 11 is a view illustrating a fixation of the partition plate and the collecting part.

First, an entire construction of the exhaust manifold of the first embodiment will be described.

Figure 2:
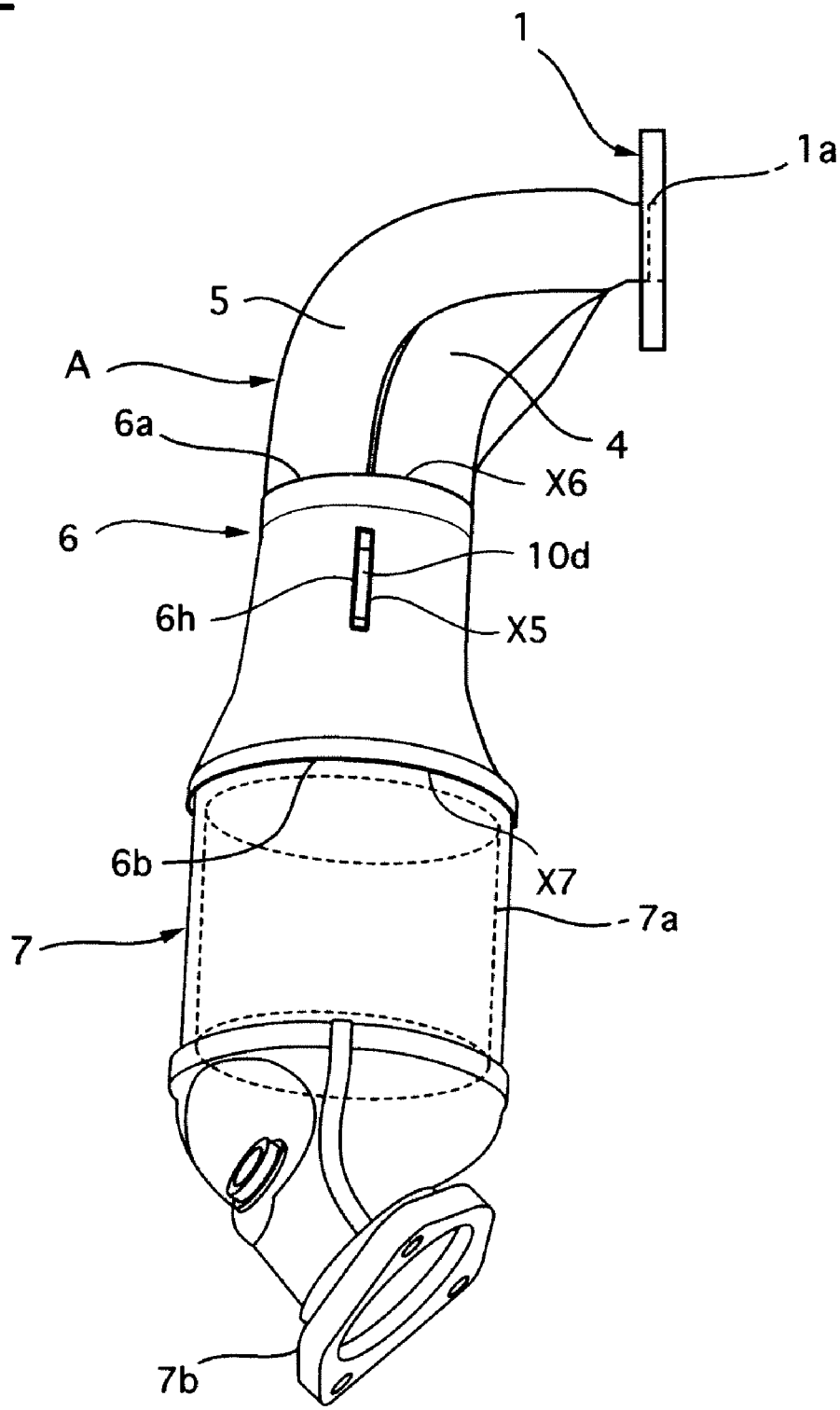
FIG. 2 is a right side view showing the exhaust manifold of the first embodiment of the present invention.

As shown in FIG. 1 and FIG. 2, the exhaust manifold A of the first embodiment includes a head flange 1, four branch pipes 2 to 5, a collecting part 6, a catalytic converter 7 and an oxygen sensor 8.

The branch pipes 2 to 5 are formed in such a way that they are bent from the head flange 1 downward to be formed like an L-letter shape.

Exhaust-gas upstream side end portions of the branch pipes 2 to 5 are connected with corresponding attachment holes 1*a* formed in the head flange 1, while exhaust-gas downstream side end portions 2*a* to 5*a* are connected with an exhaust-gas upstream side end portion 6*a* of the collecting part 6, which will be later described.

In addition, an exhaust-gas downstream side end portion 6*b* of the collecting part 6 is connected with an exhaust-gas upstream side end portion of the catalytic converter 7 that contains a catalyst substrate 7*a*.

Further, a flange portion 7*b* is provided on an exhaust-gas downstream side end portion of the catalytic converter 7 so as to be connected with a not-shown rear side exhaust pipe.

The oxygen sensor 8 is used for detecting an oxygen concentration of exhaust gas passing through the collecting part 6 to feedback-control an air-fuel ratio to be supplied to the engine. The oxygen sensor 8 is provided with a wiring 8*a* that is electrically connected to a not-shown control unit at one end portion thereof. The sensor 8 is further provided at an intermediate portion thereof with a holder portion 8*b* that contacts with a sensor attachment boss part 9 facing an attachment hole 6*f* of the collecting part 6, and it is provided at the other end portion thereof with a sensing part 8*c* that is arranged in the center of the collecting part 6, corresponding to the center of the exhaust gas flow, through the holder portion 8*b* and the attachment hole 6*f*.

A detail description will be given below about a construction of the exhaust-gas downstream side end portions 2*a* to 5*a* of the branch pipes 2 to 5 and the collecting part 6.

As shown in FIG. 3 and FIG. 4, the exhaust-gas downstream side end portions 2*a* to 5*a* of the branch pipes 2 to 5 are formed to have a cross section of a quarter circular shaped, so that they are inserted into the exhaust-gas upstream side end portion 6*a* of the collecting part 6 in a state where they are assembled with each other to form a circular cross section.

In addition, a partition plate 10, which is a flat plate, is arranged between the exhaust-gas downstream side end portions 2*a* and 3*a* of the branch pipes 2 and 3 and also between the exhaust-gas downstream side end portions 4*a* and 5*a* of the branch pipes 4 and 5 so that the partition plate 10 projects toward a downstream side of the exhaust gas. The partition plate 10 is fixed with side wall portions 2*b* to 5*b* of the branch pipes 2 to 5 by a first weld line X1, and the adjacent side wall portions 2*c* to 5*c* thereof are fixed with each other by a second weld line X2.

Further, as shown in FIG. 4, the partition plate 10 is formed to have a dimension of the maximum width W1 thereof such that it can be inserted into the exhaust-gas upstream side end portion 6*a* of the collecting part 6, and its exhaust-gas downstream side end portion 10*a* is provided parallel to a direction perpendicular to an axial direction of the collecting part 6, being formed with an engagement stepped portion 10*b* at one side of the both end portions of the exhaust-gas downstream side end portion 10*a*.

As shown in FIGS. 5 to 9, the collecting part 6 is constructed by two divided bodies 6*c* and 6*d* that are shaped like a semi-circular cylinder, in such a way that the divided bodies 6*c* and 6*d* are coupled and welded with each other at their both edge portions by third and fourth weld lines X3 and X4. The exhaust-gas upstream side end portion 6*a* thereof has an opening into which the exhaust-gas downstream side end portions 2*a* to 5*a* of the branch pipes 2 to 5 can be inserted, and the intermediate portion thereof is formed as a reduced diameter portion 6*e* in a direction perpendicular to a plane substantially on which the branch pipes 2 to 5 are bent like the L-letter shape.

In addition, the attachment hole 6*f* is formed in a portion corresponding to the reduced diameter portion 6*e* of the divided body 6*c*, and an insertion hole 6*g*, which is formed like a vertically long slit, is provided on the corresponding portion above and near the attachment hole 6*f*.

Further, an insertion hole 6*h*, which is formed like a vertically long slit, is provided on the portion corresponding to the reduced diameter portion 6*e* of the divided body 6*d* at a position opposite to the insertion hole 6*e*.

The partition plate 10 is contained in the interior of the exhaust-gas upstream side end portion 6*a* of the collecting part 6 in a state where a portion of the exhaust-gas downstream side end portion 10*a* of the partition plate 10 and the engagement stepped portion 10*b* thereof contact with the deepest portions 6*i* and 6*j* of the corresponding insertion holes 6*g* and 6*h*, respectively, and portions 10*c* and 10*d* of the both end portions of the partition plate 10 projects outward through the insertion holes 6*g* and 6*h*.

Further, the portions 10*c* and 10*d* of the both end portions of the partition plate 10 are fixed by a fifth weld line X5 on a portion of the outer circumferential portion of the collecting part 6 along the corresponding insertion holes 6*g* and 6*h* as shown in FIG. 1 and FIG. 2. The exhaust-gas upstream side end portion 6*a* of the collecting part 6 is fixed by a sixth weld line X6 with the outer circumferential portions of the branch pipes 2 to 5 all around them, and the exhaust-gas downstream side end portion 6*b* thereof is fixed by a seventh weld line X7 with the outer circumferential portion of the catalytic converter 7 all around it.

The sensor attachment boss part 9 is fixed by an eighth weld line X8 with a part of the outer circumferential portion of the collecting part all around the boss part 9 in the state where the boss part 9 faces the attachment hole 6*f* of the collecting part 6.

In addition, the oxygen sensor 8 is fixed on the sensor attachment boss part 9 in a state where the boss portion 8*b* of the sensor 8 contacts on an upper surface of a sensor attachment boss part 9, by a not-shown external thread formed on a base portion side of the sensing portion 8*c* and a not-shown internal thread formed on an inner surface of the sensor attachment boss part 9 being screwed with each other, and also in a state where the sensor 8 is inserted to the center of the collecting part 6 through the sensor attachment boss part 9 and the attachment hole 6*f*.

All of the parts described above are made of metal material. However, the catalyst substrate 7*a* is not made of the metal material, and it may be a ceramic catalyst substrate.

Next, how to manufacture the exhaust manifold of the first embodiment will be described.

In order to assemble the collecting part 6 of the exhaust manifold A, first, the exhaust-gas upstream side end portions of the branch pipes 2 to 5 are connected with the head flange 1. On the other hand, the exhaust-gas downstream side end portions 2*a* to 5*a* thereof are fixed by the first weld line X1 with the partition plate 10, and they are also fixed by the second weld line X2 with each other.

On the other hand, the divided bodies 6*c* and 6*d* are coupled with each other to form like a barrel, and they are fixed with each other by the third and fourth weld lines X3 and X4 to form the collect part 6, and then the sensor attachment boss part 9 is fixed on the divided body 6*c* by the eighth weld line X8 all around the boss part 9 in the state where the boss part 9 faces the attachment hole 6*f* of the collecting part 6.

In this weld process, the first embodiment can remove a thermal deformation, due to heat input at the eighth weld line X8, to reduce the diameter of the upstream side end portion 6*a* and the downstream side end portion 6*b* of the collecting part 6 that has a heat capacity smaller than that of the sensor attachment boss part 9, because there is no slit that vertically opens in the downstream side end portion 6*a* and the downstream side end portion 6*b* of the collecting part 6 of the embodiment, differently from the conventional inventions.

Incidentally, after the boss part 9 is fixed by the eighth weld line X8 on a portion corresponding to the attachment hole 6*f* of the divided body 6*c*, the both divided bodies 6*c* and 6*d* are coupled and fixed by the third and fourth weld lines X3 and X4 with each other like the barrel to form the collecting part 6.

Next, the downstream side end portion 6*b* of the collecting part 6 are fixed and connected with the catalytic converter 7 by the seventh weld line X7 all around the downstream side end portion 6*b*.

At last, as shown in FIG. 11, the partition plate 10 is inserted in the interior of the exhaust-gas upstream side end portion 6*a* of the collecting part 6, the portions 10*c* and 10*d* of the both end portions of the partition plate 10 are fixed with the collecting part 6 by the fifth weld line X5 along the corresponding insertion holes 6*g* and 6*h* in the state where the portion of the exhaust-gas downstream side end portion 10*a* and the engagement stepped portion 10*b* of the partition plate 10 are contacted with the deepest portions 6*i* and 6*j* of the corresponding insertion holes 6*g* and 6*h*. In addition, the exhaust-gas upstream side end portion 6*a* of the collecting part 6 is fixed by the sixth weld line X6 with the outer circumferential portions of the branch pipes 2 to 5 all around the end portions 6*a* so that the partition plate 10 is connected with the collecting part 6. Thus the desired exhaust manifold A can be obtained.

In this last process, the partition plate 10 can be properly positioned when it is inserted into the collecting part 6, by contacting the portion of the exhaust-gas downstream side end portion 10*a* and the engagement stepped portion 10*b* of the partition plate 10 with the deepest portions 6*i* and 6*j* of the corresponding insertion holes 6*g* and 6*h*. Therefore, they can be easily assembled with each other with high accuracy.

In addition, the fifth weld line X5 does not cross with the sixth weld line X6, so that the heat stress that acts on the exhaust-gas upstream side end portion 6*a* of the collecting part 6 due to the heat input by the fifth weld lines X5 and X6 can be decreased.

Further, the length of the fifth weld line X5 can be shorter than those of the conventional inventions, and accordingly its welding time can be also shorten, thereby decreasing the quantity of the input heat inputted to the collecting part 6.

Next, the effects of the exhaust manifold of the first embodiment will be described.

As explained above, the collecting part structure of the exhaust manifold includes the plurality of branch pipes, the collecting part, the partition plate and the sensor attachment boss part. The branch pipes have the exhaust-gas upstream side end portions that are connected with the head flange. The collecting part collects and contains the exhaust-gas downstream side end portions of the branch pipes. The partition plate has the exhaust-gas upstream side end portion is fixed among the exhaust-gas downstream side end portions of the branch portions, and the partition plate is arranged in the state where the exhaust-gas downstream side end portion of the partition plate projects in the interior of the collecting part. The sensor attachment boss part is fixed by welding on the portion of an outer circumferential portion of the collecting part in the state where the sensor attachment boss part faces the attachment hole formed in the collecting part. The plurality of insertion holes are formed in the reduced diameter portion of the collecting part. The partition plate is fixed by welding on the portion of the outer circumferential portion of the collecting part in the state where portions of the partition plate are inserted in and positioned to the insertion holes.

Therefore, the assembly performance of the partition plate 10 and the collecting part 6 can be improved. In addition, the concentration of the heat stress can be eased in the welding process.

While there have been particularly shown and described with reference to preferred embodiments thereof, it will be understood that various design changes and modifications may be made therein, and it is intended to cover in the appended claims all such modifications as fall within the true spirit and scope of the invention.

For example, the number of the branch pipes may be set appropriately according to the number of cylinders of an engine.

In addition, it is not necessary for the collecting part to be constructed by coupling a plurality of divided bodies, and it may be constructed by using a spinning process method to be formed as one unit from a metal tube-like member.

Further, the partition plate formed like a flat plate is projected into the exhaust-gas downstream side end portion in the first embodiment, while its projecting portion may be formed like a cross shape.

The invention claimed is:

1. A collecting part structure of an exhaust manifold comprising:

a plurality of branch pipes having exhaust-gas upstream side end portions that are connected with a head flange;

a collecting part that collects and contains exhaust-gas downstream side end portions of the branch pipes;

a partition plate that has an exhaust-gas upstream side end portion is fixed among the exhaust-gas downstream side end portions of the branch portions, the partition plate being arranged in a state where an exhaust-gas downstream side end portion of the partition plate projects in an interior of the collecting part; and a sensor attachment boss part that is fixed by welding on a part of an outer circumferential portion of the collecting part in a state where the sensor attachment boss part faces an attachment hole formed in the collecting part, wherein a plurality of insertion holes are formed in a reduced diameter portion of the collecting part, and wherein the partition plate is fixed by welding on a portion of the outer circumferential portion of the collecting part in a state where portions of the partition plate are inserted in and positioned to the insertion holes.

* * * * *